US005657891A

United States Patent [19]

Bilani et al.

[11] Patent Number: 5,657,891

[45] Date of Patent: Aug. 19, 1997

[54] CONTAINER FOR FLUIDS

[75] Inventors: Nady Bilani, Strombeek-Bever; Joseph Fernand Deflander, Espelaar; Johan Willy Declerck, Ichtegem; Luc Hauben, Mechlin; Willy Aloysius Maria, Katelijne Waver, all of Belgium

[73] Assignee: The Procter & Gamble Company, Cincinnati, Ohio

[21] Appl. No.: 553,594

[22] PCT Filed: May 10, 1994

[86] PCT No.: PCT/US94/05200

§ 371 Date: Apr. 30, 1996

§ 102(e) Date: Apr. 30, 1996

[87] PCT Pub. No.: WO94/26614

PCT Pub. Date: Nov. 24, 1994

[30] Foreign Application Priority Data

May 18, 1993 [EP] European Pat. Off. ..... 93201410

[51] Int. Cl.[6] ..... B65D 51/16

[52] U.S. Cl. ..... 220/256; 220/303; 215/261; 222/95

[58] Field of Search ..... 215/261, 307, 215/308, 309, 310; 220/256, 303, 371, 372, 373; 222/95

[56] References Cited

U.S. PATENT DOCUMENTS

| | | | |
|---|---|---|---|
| 3,315,831 | 4/1967 | Scott | 215/56 |
| 3,315,832 | 4/1967 | Scott | 215/56 |
| 3,351,497 | 11/1967 | Lucas | 136/178 |
| 3,471,051 | 10/1969 | Cistone | 215/40 |
| 3,951,293 | 4/1976 | Schulz | 215/261 |
| 3,952,902 | 4/1976 | Prouty et al. | 215/306 |
| 4,136,796 | 1/1979 | DuBois et al. | 220/256 |
| 4,349,122 | 9/1982 | Klar et al. | 220/373 |
| 4,545,495 | 10/1985 | Kinsley | 215/235 |
| 5,305,920 | 4/1994 | Reiboldt et al. | 222/95 |
| 5,318,204 | 6/1994 | Davis et al. | 222/95 |
| 5,577,625 | 11/1996 | Baird et al. | 215/235 |

FOREIGN PATENT DOCUMENTS

| | | | |
|---|---|---|---|
| A2509258 | 4/1975 | Germany | B65D 51/16 |
| A2032892 | 5/1980 | United Kingdom | B65D 51/16 |

*Primary Examiner*—Joseph M. Moy
*Attorney, Agent, or Firm*—Ronald W. Kock

[57] ABSTRACT

A container suitable for containing and dispensing fluid materials comprising a hollow body wherein said container comprises a sealing and venting system consisting of a perforated area (4) comprising one or more perforations of the container in combination with a fluid-impermeable but gas-permeable membrane applied to said perforated area (4) such as to provide a liquid-impermeable sealing means (1) and gas-permeable venting means characterized in that said membrane is treated to reduce its surface energy.

5 Claims, 2 Drawing Sheets

CONTAINER FOR FLUIDS

FIELD OF THE INVENTION

The present invention relates to a container suitable for containing and dispensing fluids which includes a sealing and venting system. The sealing and venting system enables passage of air/gas to and from the inside of the container in response to small differences which exist between the pressure inside the container and the ambient environmental pressure.

BACKGROUND OF THE INVENTION

The problem of container deformation in response to pressure differences existing between the inside of a container, which is sealed to prevent leakage of any fluid contents, and the ambient atmospheric pressure, is well known in the packaging industry. Such container deformation may for certain container materials, especially some plastics, be non-recoverable.

Thin-walled, partially flexible containers which are often made of plastic material are particularly subject to the problem.

If the pressure in the container is higher than that of the ambient atmospheric pressure the container will tend to bulge, and may split or in extreme circumstances explode. If the pressure in the container is lower than that of the ambient atmospheric pressure the container wild tend to sag or be subject to inward collapse, this effect sometimes being referred to as 'panelling'. The problem is most noticeably visible for essentially cylindrical containers.

The existence of pressure differences between the inside of a container having fluid contents and the ambient environmental pressure may also lead to mess when dispensing the contents. Where there is a positive pressure inside the container which rapidly equilibrates with the ambient on opening of the container, the fluid contents may spurt out causing unwelcome mess, or a possible safety hazard if product is spurted into the eyes of the opener.

There are a number of possible factors which may lead to the existence of the afore-mentioned pressure differences. The liquid contents of the container may, for example, be inherently chemically unstable or may be subject to reaction with any headspace gases in the container, or alternatively, in certain specific circumstances, may react with the container material itself. Any chemical reactions involving the liquid contents may lead to either production of gases, and hence to overpressure in the container, or to the absorption of any headspace gases thereby causing underpressure in the container.

Examples of liquid products which may react such as to generate pressure inside a container would include those products containing bleach components, Examples of liquid products which may be subject to reaction with headspace gases, particularly oxygen, such as to generate negative pressure inside a container include liquid detergent products, such as light duty liquid detergents, especially those containing certain perfume components, The problem of container deformation as a result of chemical reactions involving the contents may, where the reaction is photolytically activated, be mitigated by making the container out of an opaque material. Opaque containers are however often perceived by consumers as being less aesthetically pleasing, and do not afford the possibility of being able to see clearly how much product remains in a partially filled container.

The Applicants have discovered that it is often red light (of approximately 410–500 nm wavelength) which photolytically activates the reaction of many perfume components commonly employed in detergent products. Where this is the case these unwelcome reactions of the perfumes can be mitigated by constructing the container out of a material capable of absorbing red light.

Storage of the container and contents at a low temperature may slow any chemical reaction processes. Cold storage may however, for reasons detailed below, tend to cause container deformation.

Pressure differences between the inside container pressure and ambient atmospheric pressure may also occur due to variations between container filling and storage temperatures. For example, the contents of the container may be added to the container at a temperature significantly different from the ambient environmental temperature, with the temperature of the contents being allowed to equilibrate to the ambient temperature whilst in the sealed container. Alternatively, the container may, for example, be filled with product at the ambient temperature of a typical factory working environment (say, 18°–22° C.) but then be stored in a cold warehouse, or be transported to be sold in an equatorial geography where typical daytime temperatures exceed 30°–35° C.

Pressure differences between the inside container pressure and ambient atmospheric pressure may even occur due to differences in the local ambient atmospheric pressure on filling and the local ambient atmospheric of the geographic location to which the product is transported.

Whilst the problem of container deformation as described above is most commonly found for essentially filled or partially filled containers, where the possibility of contents chemical instability is a particular source of the problem, the Applicants have also observed the problem to occur with empty containers, and particularly with empty sealed plastic bottles.

The problem of container deformation is less apparent in thick-walled containers which are by their nature less deformable. Consideration of cost and the desire to minimise usage of material resources, thereby reducing environmental impact, however, tends to favour use of thin-walled containers where possible.

Containers for many consumer products include devices for dispensing product in response to compression of the container by the user. Such containers, which would include for example squeezy plastic dishwashing or multi-purpose household cleaner liquid bottles, are by their nature made of flexible material to allow for compression, but are thus also inherently subject to deformation in response to other external factors.

Solutions to the problem of container deformation in response to differences between internal container pressure and external ambient pressure have been proposed in the art. Proposed solutions have included designing containers of specific shapes whereby the shape of the container has optimal resistance to deformation. This type of solution has the drawback that it limits the flexibility in designing such containers.

Other proposed solutions to the specific problem of build-up of overpressure in the container have included various valve systems. Further proposed solutions relate to various venting caps for containers which allow pressure generated inside the container to be released by escape of gas. U.S. Pat. No 3,315,831, U.S. Pat. No. 3,315,832, GB-A-2,032,892 and FR-A-1,490,177 for example disclose venting caps including composite cap liners. Co-pending European Application No. 92202223.1 discloses a venting and dispensing cap which allows for the dispensing of any liquid contents without the cap having to be removed from the container.

U.S. Pat. No. 3,471,051 describes a self-venting closure for containers including a composite venting liner composed of an asbestos-fiber lining material which is at least partly faced with a fibrous, spun-bonded sheet material.

FR-A-2,259,026 describes a venting closure including a gas-permeable venting liner comprised of polytetrafluorethylene material.

U.S. Pat. No. 4,136,796 describes a venting closure for a container including a membrane which is porous to gas under pressure wherein the membrane is formed from a cloth fabricated from fluorocarbon filaments. De-A-2,509,258 describes a pressure compensation screw cap including a venting seal made from fine cotton fabric impregnated with the polymer of a fluorinated or chlorinated hydrocarbon.

The Applicants have now discovered a sealing and venting system which provides a distinct solution to the aforementioned problem. The Applicant's sealing and venting system consists of a perforated area on to which is applied an essentially fluid-impermeable but gas-permeable membrane such as to provide a liquid/fluid leak tight seal under normal usage conditions which however allows venting of gases both in to and out of the container in response to small pressure differences. The membrane is treated to reduce its surface energy. The membrane is preferably formed from a synthetic material. The Applicant's sealing and venting system provides for rapid response to both underpressure and overpressure inside the sealed container, thus essentially preventing the container deformation problem.

The Applicant's distinct solution does not require the use of valves or venting caps of the type known in the art, which are often quite complex and can require expensive manufacturing. The Applicant's solution, unlike the valve systems known in the art, allows for two-way venting in response to relatively small pressure differences.

Co-pending European Application No. 92870173.9 discloses a plastic material which is impermeable to liquids, but permeable to gases. It is also disclosed that containers suitable for containing liquids which generate pressure inside a closed container can be made from said material. There is no disclosure in this co-pending Application of a sealing and venting system consisting of a perforated area in combination with a membrane of fluid-impermeable but gas-permeable material applied to the perforated area. The current invention provides the advantage that only a membrane of the fluid-impermeable but gas-permeable material is required, whilst the rest of the container may be made from conventional, cheaper materials.

SUMMARY OF THE INVENTION

A container suitable for containing and dispensing fluid materials comprising a hollow body wherein said container comprises a sealing and venting system consisting of a perforated area comprising one or more perforations of the container in combination with a fluid-impermeable but gas-permeable membrane applied to said perforated area such as to provide a liquid-impermeable sealing means and gas-permeable venting means characterized in that said membrane is treated to reduce its surface energy.

According to another aspect of the present invention the fluid-impermeable sealing means and gas-permeable venting means enables two-way venting of air/gas both into and out from the container in response to a pressure difference of less than 100 millibar, particularly less than 50 millibar, especially less than 30 millibar, between the local pressure inside the container and the ambient environmental (external) pressure thereby essentially preventing deformation of the container which may occur because of said pressure difference.

According to an especially preferred aspect of the present invention the fluid-impermeable but gas-permeable membrane is a microporous synthetic membrane, preferably having a mean pore size of from 0.2 to 3 microns. The membrane is preferably treated to achieve essentially complete impermeability to fluids having a surface tension of 30 dynes/cm or less.

In one preferred execution said container further comprises a discharge orifice, and a means for reversibly sealing said discharge orifice.

DETAILED DESCRIPTION OF THE INVENTION

Figure 1:
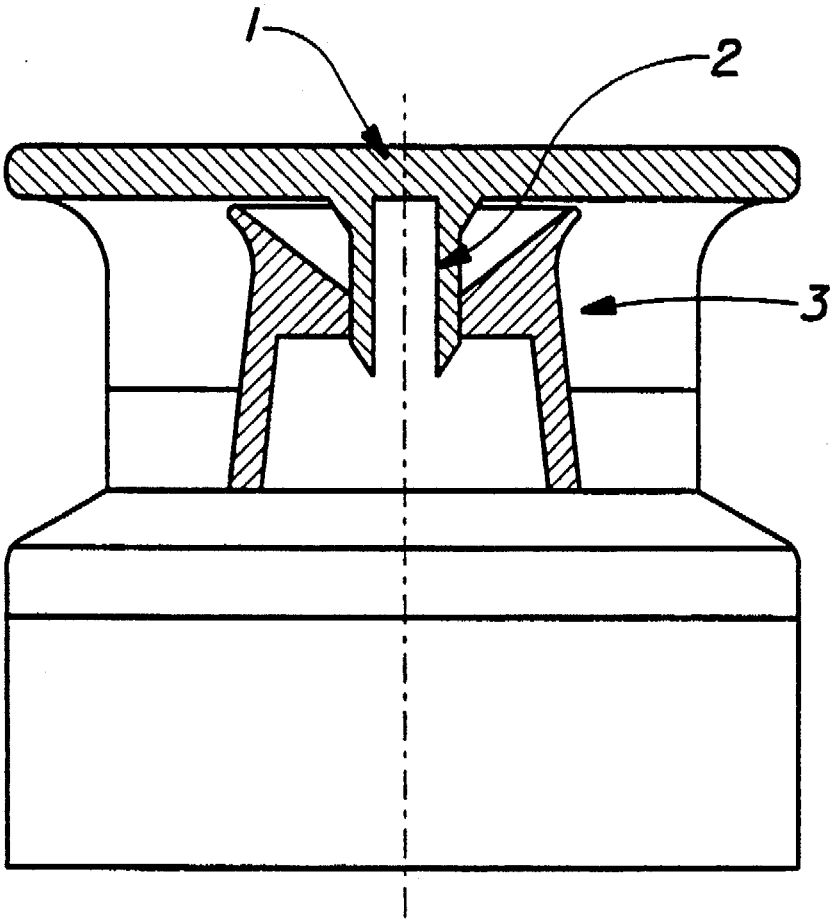
FIG. 1 shows a conventional flip-top closure and FIG. 2 a flip-top closure comprising a fluid-impermeable sealing means and gas-permeable venting means in accord with the invention.

The invention provides a container suitable for containing and dispensing fluid materials comprising a hollow body wherein said container comprises a sealing and venting system.

The container should be flexible to the extent that it may deform in response to pressure differences arising between the inside of the container and the ambient external pressure. The magnitude of such pressure differences may typically be as small as 50 millibar (approx. 0.05 atmosphere), or even as small as 30 millibar (approx 0.03 atmosphere), in the case of a negative pressure inside the container. Such small negative pressures may arise, for example, inside a squeezy plastic bottle partially filled with dishwashing liquid. Larger pressure differences may however be encountered in the case of a container with unstable bleach components, including hydrogen peroxide, as part of the contents.

Whilst the container should be, to an extent, flexible it may also be essentially rigid in structure in the absence of any pressure differences or external compressive forces. Containers which are essentially non-rigid and therefore largely structureless, such as thin plastic pouches, are however, also encompassed by the present invention. Plastic pouches find common use in the marketplace as refill packs for detergent products, such as heavy duty liquid detergents.

Where the container is essentially rigid it may be formed in any suitable shape. Suitable shapes of containers would include essentially cylindrical, tapered cylindrical, oval, square, rectangular or flat-oval container shapes.

The container may be made of essentially any material such as plastics, metal, paper, or combinations of these materials as layers, laminates or co-extrudates. The materials may be virgin or recycled or combinations of both. Preferred container materials include plastics such as polyethylene (high or low density), polyvinyl chloride, polyester, PET, PETG, polypropylene, polycarbonate and nylon, which may be used individually or be combined as coextrudates, layers or laminates. A preferred container material comprises recycled plastic material sandwiched between layers of virgin plastic material.

The container should be suitable for leak tight containment of fluid materials, particularly those having a surface tension of 30 dyne/cm or less. Fluid materials would include water, liquids, pastes, creams and gels. The containers of the invention are especially suitable for containing fluid household products such as dishwashing liquids, heavy duty liquid detergents, hard-surface and household cleaners, liquid shampoos, liquid bleaches, personal/beauty care liquids, creams and toothpastes.

The container comprises a sealing and venting system consisting of a perforated area comprising one or more perforations of the container in combination with a fluid-impermeable but gas-permeable membrane applied to the perforated area such as to provide a fluid-impermeable sealing means and gas-permeable venting means. By membrane herein it is meant a thin layer, which may be used to cover the perforated area.

The perforated area will comprise one or more perforations of suitable size to allow for passage of air/gas. Preferably, the perforations have a diameter of at least 0.1 mm, since below that perforation size clogging of holes by the fluid contents may become a problem, particularly if the membrane is applied to the exterior of the container.

The membrane must be impermeable to fluid/liquid flow but permeable to gas flow particularly, in response to small pressure differences, as low as 100 millibar, particularly as low as 50 millibar. The thickness of the membrane is a matter of choice but typically would be in the region 0.01 mm to 2 mm, preferably from 0.02 mm to 1 mm, more preferably from 0.05 mm to 0.5 mm. The membrane can comprise essentially any material which may be formed into thin layers such as plastics, paper or metal.

The membrane is preferably composed of synethetic material. Preferred synthetic membrane materials include microporous plastic films. The size of the micropores of any microporous membrane material should be such as to allow passage of air/gas but to provide fluid impermeability. Typically, the micropores will be in the region of 0.05 to 10 micrometres, preferably 0.2 to 3 micrometres.

Preferred microporous membrane materials include non-woven plastic films, especially the non-woven spunbonded polyethylene film material sold under the tradename, Tyvek by the Du Pont Company.

Synthetic membrane materials prepared from sintering, stretching, track-etching, template leaching and phase inversion methods are useful herein.

The membrane is treated to reduce its surface energy and therefore to improve the leak tightness of the film. The lowering of the surface energy of the film material is particularly necessary to improve leak tightness where the container will contain products including surfactant components, For this application in particular, the surface energy of the film material should be lower than that of the surfactant-containing product to achieve essentially complete impermeability to the product contents. The surface energy of the membrane, subsequent to treatment, should preferably be less than 30 dyne/cm, preferably less than 20 dyne/cm, more preferably less than 15 dyne/cm.

Fluorocarbon treatment which involves fixation of a flurocarbon material, on a micro scale, to the surface of the film is a preferred example of a treatment which provides such reduced surface energy, and hence provides improved fluid impermeability. When used to treat a film material for use in accord with the invention however, this fluorocarbon treatment should not compromise the gas permeability of the film.

Fluorination treatment may also be used to reduce the surface energy of the film and hence to improve its fluid impermeability. The fluorination treatment reduces the susceptibility of the film to wetting by the product contents. In more detail, the fluorination treatment process involves applying dilute fluorine gas to the film, thereby fluorinating hydrocarbon molecules on the surface of the film.

The method of treatment of the membrane to provide the required reduction in surface energy may also comprise coating a surface of the membrane with a suitable material, such as a fluorocarbon material. A preferred fluorocarbon coating material is sold under the tradename Scotchban L12053 by the 3M Company.

The membrane may be applied to the perforated area by essentially any means which thereby enable the provision of a fluid-impermeable sealing means and gas-permeable venting means. The means of application may therefore include the use of adhesives, or heat-generating sealing techniques, ultrasonic sealing, high frequency sealing, or mechanical means for applying the film such as clamping, rivetting or hot-stamping, or in a particularly preferred execution by an insert moulding method, that is by insertion of the film during moulding of the container. The sealing means employed should not significantly comprise the venting ability of the membrane. For this reason it is preferred that any adhesive which is used as an application means is also breathable, or does not fill up the pores of the film material.

In one preferred execution the membrane is coated, wholly or partially, with a self adhesive glue, to provide the means of application of the membrane to the perforated area of the container. The glue may be applied selectively to the membrane such that areas of the membrane which are to be placed directly over a perforation of the container are free from glue, thus preventing the possibility of glue blocking the perforation. The self adhesive glue is most preferably gas-impermeable in nature.

In another preferred execution the container is built up of two or more layers of container material, wherein each layer of container material has a perforated area, wherein said perforated areas are essentially coterminous, and wherein the membrane is applied as an insert between any of the essentially coterminous perforated areas of the layers of container material. In this execution the preferred container material is polyethylene.

In one preferred execution the container further comprises a discharge orifice, and a means for reversably sealing said discharge orifice. The discharge orifice may be an opening of essentially any shape or size which enables discharge of the fluid contents. Typically, however the discharge orifice will be circular with a diameter of between 0.5 mm and 100 mm.

The means for reversably sealing said discharge orifice preferably comprises a reclosable dispensing system. This reclosable dispensing system may comprise a cap, of the screw-on or snap-on type, or may comprise a more complex dispensing system such as a flip-top closure, push-pull closure, spray trigger closure, self-draining closure or turret cap closure.

The reclosable dispensing system may comprise the aforementioned sealing and venting system. In a particularly preferred execution the reclosable dispensing system is a flip-top closure comprising the sealing and venting system.

The invention will be further illustrated by the following non-limiting examples:

EXAMPLES

Example 1

Two sets of white, essentially cylindrical plastic test bottles each with a fliptop closure, having a volume of 565 ml were charged with 500 ml of perfumed dishwashing liquid (of the type sold under the tradename Fairy, by The Procter and Gamble Company). The 'headspace' volume was therefore 65 ml.

One set of the bottles (bottle type A) comprised a conventional leak tight fliptop closure. The other set (bottle type B) of bottles comprised flip-top closures including the sealing and venting system in accord with the invention. In detail, the sealing and venting system comprised a hole of diameter approximately 0.1 mm drilled through the lid of the flip-top cap element of the flip-top closure, and a layer of Tyvek, Type 10 (tradename of the Du Pont Company) film coated with Scotchban L12053 (tradename of 3M Company) applied to the hole using an air-permeable adhesive to provide the sealing and venting means.

The conventional flip-top closure and flip-top closure of this Example are likely to be better understood by reference to FIGS. 1. and 2. respectively.

Figure 2:
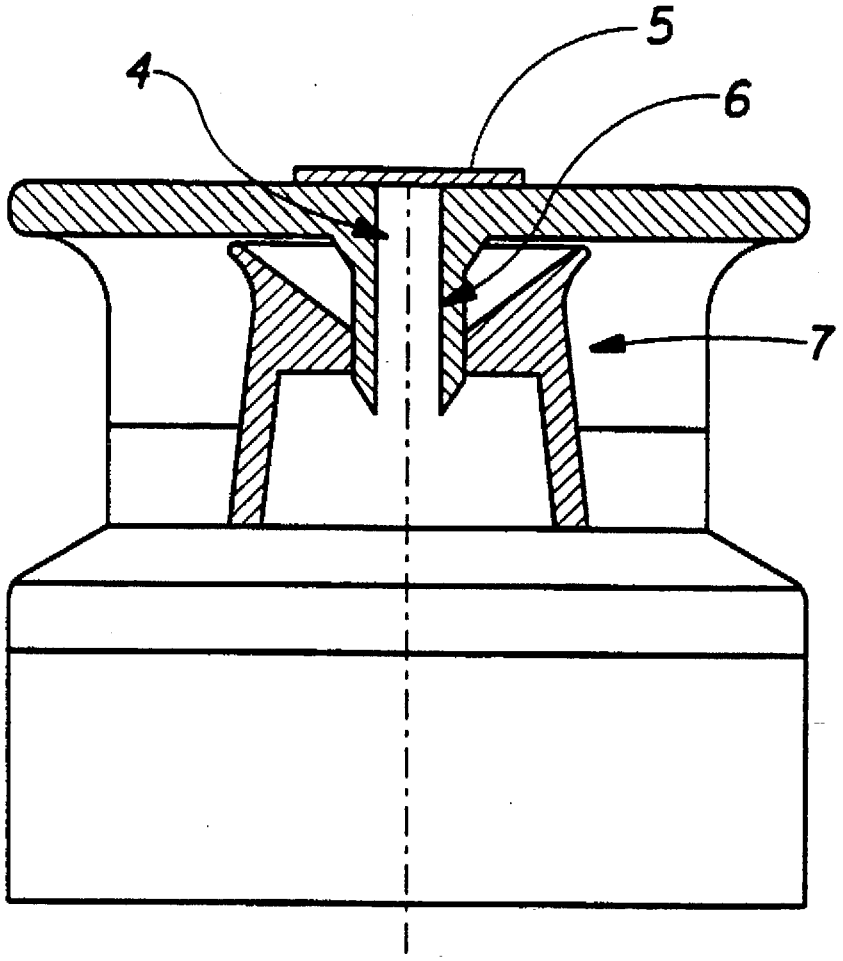

FIG. 1. shows a conventional flip-top closure, where (1) is the lid of the cap, (2) is the orifice sealing pin, (3) is the trumpet dispenser. FIG. 2. shows a flip-top closure incorporating the sealing and venting system of the invention where (4) is a perforation drilled through the lid of the cap, (5) is the coated/treated membrane material, (6) is the orifice sealing pin and (7) is the trumpet dispenser.

Samples of the sets of partially-filled test bottles were assessed for pressure variation deformation using the a 'window exposure' and 'cold storage' test. Each test was carried out at least in duplicate to give the final quoted test results.

Deformation was assessed by an expert grader using the following grading scale:

A No deformation

B Minor deformation, not visually noticeable to consumers

C Deformation, noticeable to critical consumers

D Strong deformation, clearly consumer noticeable

Grading was made by reference to a set of photographs of bottles of the same type as those used in the tests, showing the degree of defomation associated with each value on the scale. The use of such a visual grading scale provides a practical method for assessing container deformation. More standardized, numerical methods of assessing container deformation proved difficult to derive since bottles will not always deform in a uniform manner. In fact the place and nature of deformation may to an extent be dependent on any local weak spots in the bottle structure, which will vary from bottle to bottle.

Window Exposure Test

A sample of ten partially filled test bottles, five (type B) with sealing and venting means (Set 2) and five (type A) without (Set 1), were placed on a window sill to expose them to natural daylight. The positions of the bottles on the sill was switched each day of the test to provide near-uniformity of exposure to daylight. The bottles were graded to assess leak tightness, and bottle deformation at one week intervals. The following results were obtained:

| | Set 1 | Set 2 |
|---|---|---|
| 0 weeks | 100% Grade A | 100% Grade A |
| 1 week | 50% Grade A<br>50% Grade B | 100% Grade A |
| 2 weeks | 20% Grade A<br>30% Grade B<br>50% Grade C | 100% Grade A |
| 3 weeks | 10% Grade B<br>50% Grade C<br>40% Grade D | 100% Grade A |

All of the bottles showed satisfactory leak tightness throughout the duration of the test.

Cold Exposure Test

A sample of six test bottles partially filled with the perfumed dishwashing liquid, three (type B) with a flip-top closure comprising the sealing and venting means in accord with the invention (Set 4) and three (type A) with a conventional flip-top closure (Set 3) were partially submerged with the flip-top closure open to the air, in a heated water bath such as to warm the bottle contents to 35° C. Once the contents had reached this desired temperature the flip-top was closed, and the sealed bottles placed in a refrigerator at a temperature of 0° C.

The bottles were graded for deformation. After four hours all of the bottles of Set 3 were graded as being Grade D. After one week all of the bottles of Set 4 were still graded as Grade A. The leak tightness of both sets of bottles was satisfactory.

Example 2

Two sets of three plastic test bottles were taken and charged with 500 ml of water. One set (Set 6) incorporated the flip-top closure with the sealing and venting means in accord with the invention (type B), the other set (Set 5) had a conventional flip-top closure (type A). The two sets of bottles were assessed for pressure variation deformation using a variant of the 'Cold Exposure' test of Example 1, which differed only in that the bottles and contents were initially heated in the water bath to 60° C. Each test was carried out in duplicate to give the final quoted test results.

The bottles were graded for defomation. After six hours in the refrigerator at 0° C. all of the bottles of set 6 were graded at Grade A, whereas 50% of set 5 were graded Grade C, and 50% Grade D.

Example 3

Two sets of three plastic test bottles were taken. One set (Set 8) incorporated the flip-top closure with the sealing and venting means in accord with the invention (type B), the other set (Set 7) had a conventional flip-top closure (type A). The two sets of empty bottles were sealed and then assessed for pressure variation deformation using the variant of the 'Cold Exposure' test as described Example 2. Each test was carried out in duplicate to give the final quoted test results.

The bottles were graded for deformation. After six hours in the refrigerator at 0° C. all of the bottles of set 8 were graded at Grade A, whereas 50% of set 7 were graded Grade B, and 50% Grade C.

Example 4

A set of white, essentially cylindrical plastic test bottles, of bottle type A was taken. This set of bottles comprised a conventional leak tight flip-top closure. A hole of diameter approximately 4 mm was punched through the shoulder of each of the bottles, and a layer of Tyvek, Type 10 (tradename of the Du Pont Company) coated with Scotchban L12053

(tradename of 3M company) film applied to the hole using an air-permeable adhesive to provide a sealing and venting system in accord with the invention. This set of bottles performed adequately when assessed using the test protocol of Example 1. In more detail, when bottles partially-filled with perfumed dishwashing liquid were assessed for pressure variation deformation using the 'Window Exposure' and 'Cold Exposure' tests of Example 1 very satisfactory test results, showing little or no deformation, were obtained. Satisfactory leak tightness was also observed.

Example 5

Two sets of white oval bottles with a snip off spout inserted in the neck were filled with a bleach product containing hydrogen peroxide of the type sold in Italy under the trade name Ace Gentile, by Procter & Gamble, The first set of bottles had a closure formed by a snip off spout having a sealing and venting system in accord with the invention comprising 4 holes, 1.8 mm in diameter covered with a membrane formed of Tyvek (tradename) coated with Scotchban L12053 (tradename) by insert moulding. The second set had the same snip off spouts but no sealing and venting system. Both sets of bottles were put in an oven at 50° C. for ten days. After ten days not one of the 10 bottles with the insert moulded membrane in accord with the invention had suffered any significant deformation. The second set of bottles had deformed to the extent that front to back dimension had increased by 11%.

Example 6

A membrane formed of Tyvek (tradename) coated with Scotchban L12053 was fixed at the end of each of a set of ten tubes. After submerging the end of each tube with the membrane in water, air pressure was applied on the tube and the pressure recorded at which air bubbles pass through the membrane. That pressure was measured to be 20 millibar or lower.

The tubes were then filled with a bleach product containing hydrogen peroxide (of the type sold under the tradename Ace Gentile, by the Procter & Gamble Company). The fill height was 24 cm. The tubes were fixed in the upright position for 24 hours and leakage of product through the membrane was checked. No leakage occurred on the 10 samples.

Example 7

The embodiments in accord with the invention of each of Examples 1, 4, 5 and 6 were prepared other than that the venting membrane employed comprised instead a layer of Tyvek, Type 10 (tradename of the Du Pont Company) film which had been treated by fluorocarbon treatment to provide a micro layer of fluorocarbon material on the surface of the membrane.

We claim:

1. A gas venting system for a container comprising:

a) a container suitable for containing and dispensing liquids, said container having an inside and a discharge orifice, said discharge orifice having a reclosable closure to reversably seal said discharge orifice from liquid escape;

b) a perforated member located in said closure, said perforated member providing fluid communication between said inside of said container and ambient air outside said container; and c) a microporous film in contact with said perforated member, such that when said closure seals said container, said microporous film is gas permeable to vent gas into and out of said container in response to a pressure of less than 100 millibar, and is liquid impermeable to prevent passage of liquids having a surface tension of less than 30 dyne/cm.

2. A method of making a gas venting system for a container suitable for containing liquids, said container having a discharge orifice and an inside, said method comprising the steps of:

a) providing a reclosable closure to reversably seal said discharge orifice, said closure having a perforated member therein; said perforated member providing fluid communication between said inside of said container and ambient air outside said container when said closure is closed on said container;

b) applying a gas permeable film to said perforated member, said film venting gas into and out of said container in response to a pressure of less than 100 millibar; and c) treating said film to reduce its surface energy such that said film is impermeable to liquids having surface tensions below said surface energy.

3. The method of claim 2 wherein said treating step includes coating said film with a fluorocarbon material.

4. The method of claim 2 wherein said treating step includes applying a dilute fluorine gas to said film in order to fluorinate hydrocarbon molecules on a surface of said film.

5. The method of claim 2 Wherein said surface energy is less than 30 dyne/Cm.

* * * * *

UNITED STATES PATENT AND TRADEMARK OFFICE

CERTIFICATE OF CORRECTION

PATENT NO. : 5,657,891

DATED : August 19, 1997

INVENTOR(S) : Nady Bilani et al.

It is certified that error appears in the above-identified patent and that said Letters Patent is hereby corrected as shown below:

Title page, item [75], Inventors, "Willy Aloysius Maria," should read -- Willy Aloysius Maria Hertogs, --.

Column 1, line 28, "wild" should read -- will --.

Column 1, line 54, "components," should read -- components. --.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*